United States Patent [19]

Walter

[11] Patent Number: 4,516,684

[45] Date of Patent: May 14, 1985

[54] RESEALABLE CLOSURE

[75] Inventor: John Walter, Evergreen Park, Ill.

[73] Assignee: Continental Packaging Company, Inc., Stamford, Conn.

[21] Appl. No.: 598,765

[22] Filed: Apr. 10, 1984

[51] Int. Cl.[3] ..... B65D 45/32

[52] U.S. Cl. ..... 215/272; 215/274

[58] Field of Search ..... 215/250, 251, 221, 272, 215/274, 306, 317, 321

[56] References Cited

U.S. PATENT DOCUMENTS

| | | | |
|---|---|---|---|
| 3,866,782 | 2/1975 | Westfall | 215/274 X |
| 3,986,627 | 10/1976 | Zapp | 215/272 X |
| 4,192,428 | 3/1980 | Segmuller | 215/272 X |
| 4,279,353 | 7/1981 | Honma | 215/272 X |

*Primary Examiner*—Steven M. Pollard

*Attorney, Agent, or Firm*—Charles E. Brown

[57] ABSTRACT

This relates to a closure which may be fully lockingly engaged on a container neck finish in sealed relation yet may be easily released and which is replaceable to effect resealing of the contents. The closure includes primarily a cap-like closure element and a retaining ring, with the closure element having a skirt with a free end and depending from the skirt free end radially inwardly displaceable locking means which will lockingly engage in a peripheral groove in a container neck finish and which are forced into such a groove by a retaining ring which is provided with a locking groove for receiving in locking engagement radially outer portions of the locking means, whereby the retaining sleeve is locked to the closure element and the closure element is locked to the container neck finish.

13 Claims, 10 Drawing Figures

FIG.1
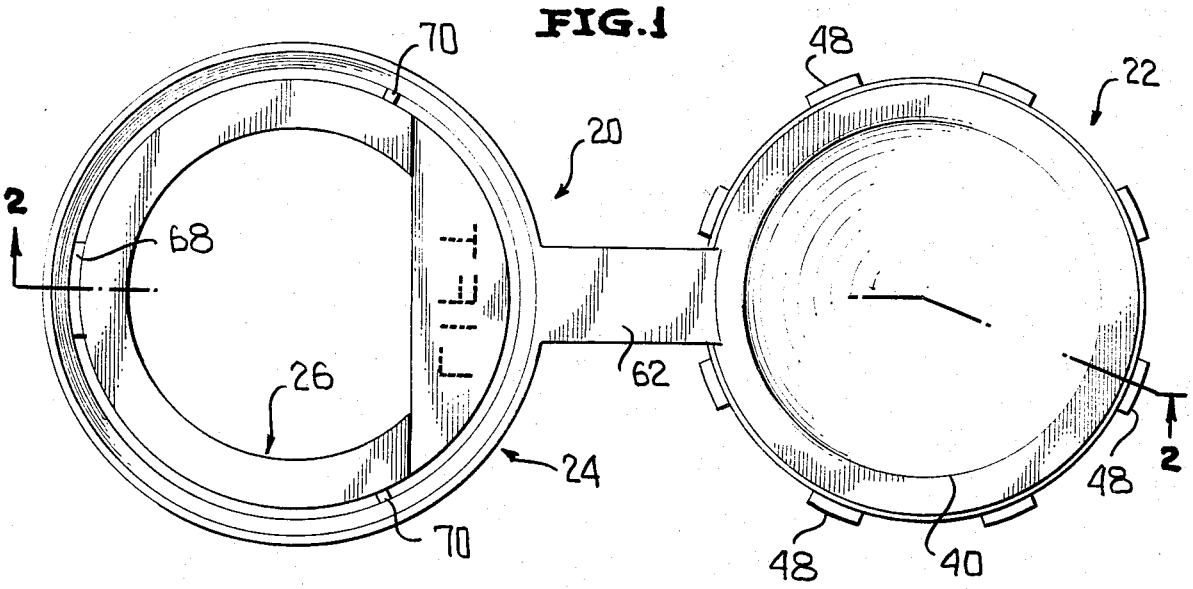
FIG.2
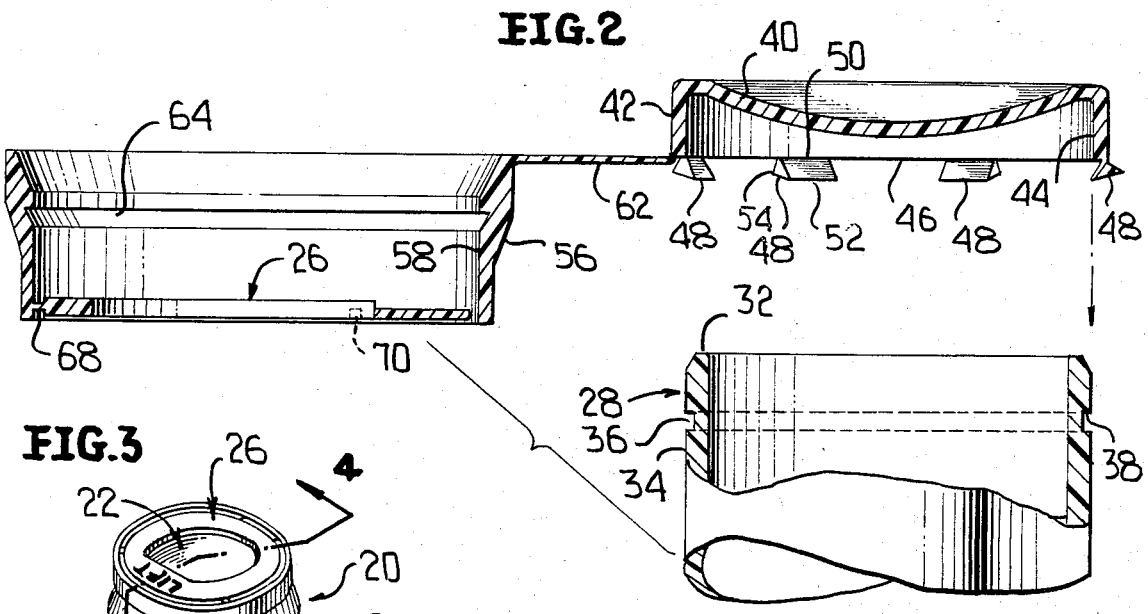
FIG.3
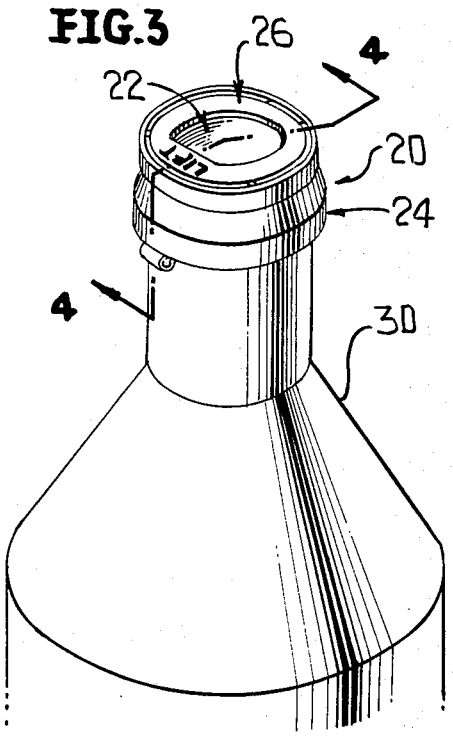
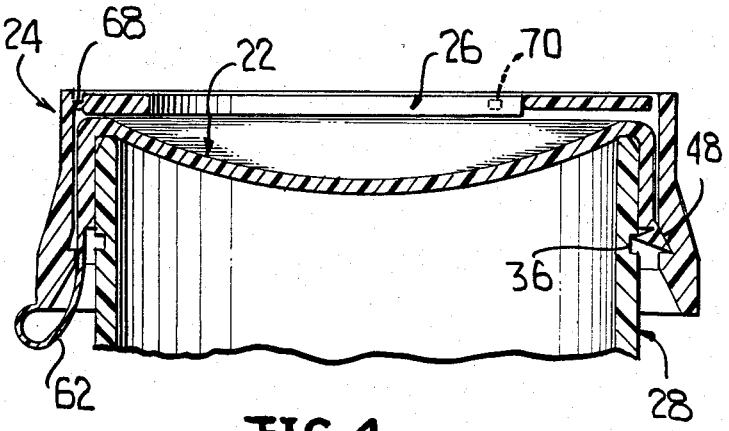
FIG.4

FIG.5
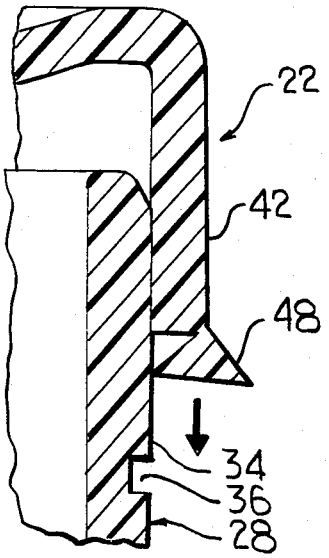
FIG.6
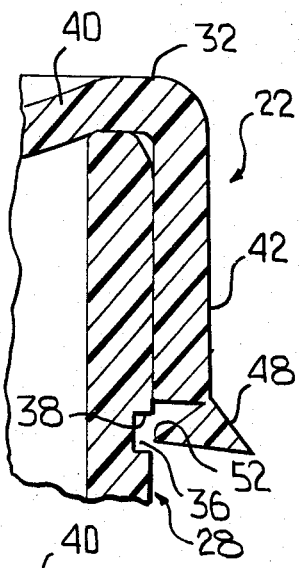
FIG.7
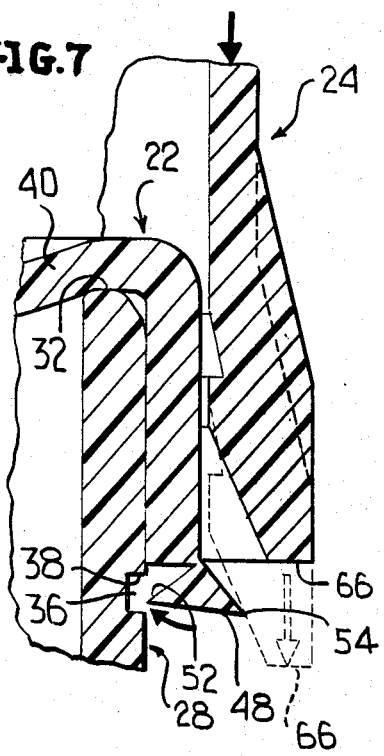
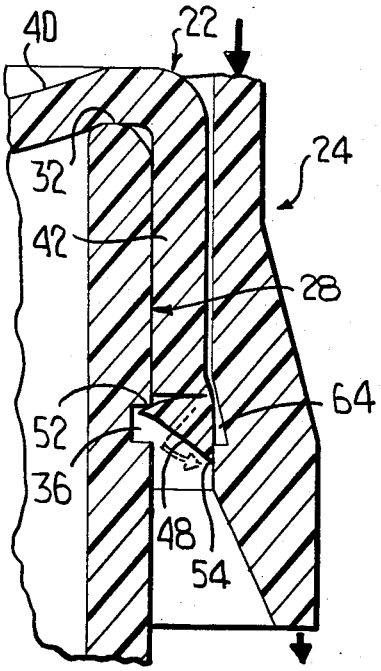
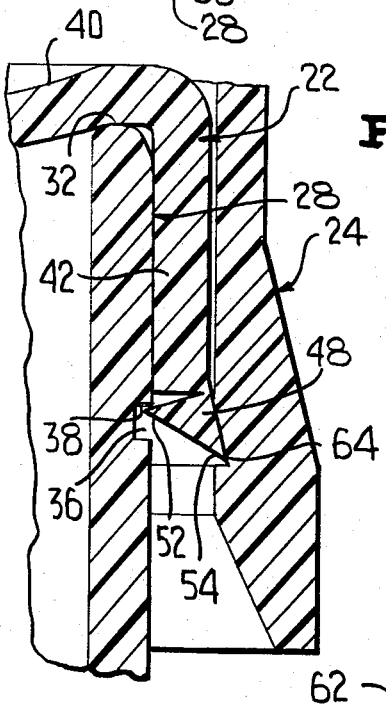
FIG.9
FIG.8
FIG.10
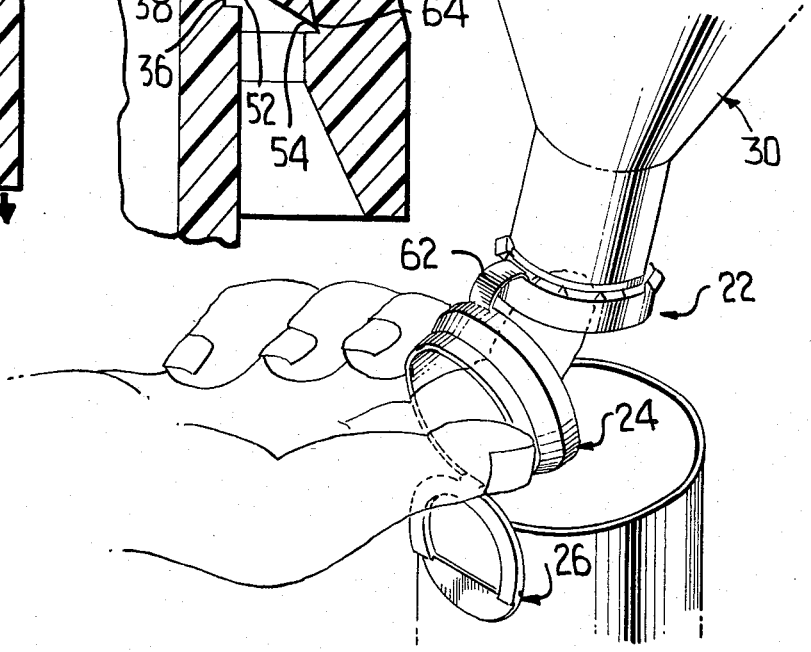

RESEALABLE CLOSURE

This invention relates in general to new and useful improvements in resealable closures, and more particularly to a closure which may be applied to the neck finish of a bottle and the like and wherein a positive locking engagement between the closure and the neck finish is effected.

Most particularly, this invention relates to a resealable closure for plastic bottles for liquids such as oil and the like wherein the bottle has a neck finish in which there is formed a peripheral groove in the outer surface and wherein the closure has locking means engageable in the peripheral groove with the locking means serving the dual function of locking the closure to the neck finish and locking in place a retaining sleeve.

With the above and other objects in view that will hereinafter appear, the nature of the invention will be more clearly understood by reference to the following detailed description, the appended claims, and the several views illustrated in the accompany drawings.

IN THE DRAWINGS

FIG. 1 is a plan view of the closure in its as molded condition.

FIG. 2 is a longitudinal vertical sectional view taken generally along the line 2—2 of FIG. 1, and more specifically shows the details of the closure.

FIG. 3 is a top perspective view of an upper portion of a bottle to which there has been applied the closure.

FIG. 4 is an enlarged fragmentary vertical sectional view taken generally along the line 4—4 of FIG. 3, and shows specifically the relationship of the closure with respect to the neck finish of the bottle.

FIG. 5 is an enlarged fragmentary schematic view showing a closure element of the closure in the process of being applied to the bottle neck finish.

FIG. 6 is a schematic sectional view similar to FIG. 5, and shows the closure element fully applied to the neck finish.

FIG. 7 is another schematic sectional view similar to FIG. 5, and shows the retaining sleeve of the closure partially telescoped over the closure element.

FIG. 8 is another schematic sectional view similar to FIG. 5, and shows the retaining sleeve engaging locking lugs carried by the closure element.

FIG. 9 is a further schematic sectional view similar to FIG. 5, and shows the locking sleeve fully in place with the closure element locked to the container neck finish and the retaining sleeve locked to the closure element.

FIG. 10 is a perspective view showing the manner in which the closure element may be maintained in place after being released from the container neck finish so that the container may be inverted without spillage.

Referring now to the drawings in detail, it will be seen that there is illustrated in FIGS. 1 and 2 a resealable closure which is formed in accordance with this invention, the closure being generally identified by the numeral 20 and being injection molded in one piece. The closure 20 is formed of three components, a closure element 22, a retaining sleeve 24, and a pull ring 26. The pull ring 26 is hingedly connected to the retaining sleeve 24 while the retaining sleeve 24 is swingably connected to the closure element 22.

The closure 20 is particularly adapted sealingly to lock onto a neck finish 28 of a bottle or like container 30. The bottle 30 is preferably formed by flow molding of a plastic material, but could be formed in other manners and of other materials.

The neck finish 28 includes an end surface 32 with which a seal is to be formed by the closure 20. The neck finish 28 also includes an external surface 34 which is normally cylindrical, but could be of other tubular shapes. Most particularly, the neck finish 28 includes a peripheral groove 36 which is axially spaced from the end surface 32 and should be of a configuration to include an upper locking shoulder 38 which faces away from the end surface 32.

The closure element 22 includes an end panel 40 and a skirt 42. The end panel 40 may be slightly axially inwardly bowed and is particularly configurated to engage the end surface 32 in sealing engagement. The skirt 42 is of a size and cross section so that an inner surface 44 thereof will snugly but slidably engage over the external surface 34 of the neck finish 28.

In order that the closure element 22 may be releasably retained on the neck finish 28 in sealing engagement with the end surface 32, a free end 46 of the skirt 42 is provided with a plurality of peripherally spaced projecting locking means in the form of lugs 48. The individual locking lugs 48 are triangular in radial cross section with one apex 50 integrally connected to the free end 46 by way of a hinge-type connection. Each locking lug 48 also includes two other spaces 52, 54 which face in opposite directions, the apex 52 being radially inwardly directed while the apex 54 is radially outwardly directed.

It is to be noted that each locking lug 48 has its apex 50 connected to a radially outer part of the end 46 so that the apex 52 substantially lies within a projection of the internal surface 44, although it may project slightly radially inwardly thereof.

It will be seen that when the closure element 22 is telescoped over the neck finish 28 and the end panel 40 is sealingly engaged with the end surface 32, the locking lugs 48 will be so axially positioned with respect to the neck finish 28 that the apices 52 of the locking lugs 48 will be in positions for entering the peripheral groove 36 and locking behind the shoulder 38.

In order to force the apices 52, of the peripheral groove 36 behind the shoulder 38, there is provided the retaining sleeve 24. The retaining sleeve 24 includes a sleeve portion 56 having an inner surface 58 of a cross section and dimension to telescope over the skirt 42.

The retaining sleeve 24 is hingedly connected to the closure element 22 by way of a foldable tether 62 which extends from a lower part of the skirt 42 to a lower part of the sleeve portion 56 and which is of a length to permit the retaining sleeve 24 to have its sleeve portion 56 telescoped over the closure element 22 as is clearly shown in FIGS. 3 and 4.

At this time it is pointed out that the interior surface 58 is provided with a locking groove 64 into which the apices 54 of the locking lugs 48 will project in the applied condition of the closure 20.

With reference to FIGS. 5–9, it will be seen that in the application of the closure 20 to a container 30 the skirt 42 of the closure element 22 is telescoped over the neck finish 28 and is moved axially down the neck finish. The locking lugs 48 will freely slide over the surface 34 of the neck finish as shown in FIG. 5.

When the closure element 22 has been fully applied to the neck finish 28 as shown in FIG. 6, the locking lugs 48 will be positioned in the same plane as the peripheral groove 36 and if moved radially inwardly would lock behind the shoulder 38.

In FIG. 7 there is illustrated the retaining sleeve 24 partially telescoped over the closure element 24. As the retaining sleeve 24 is moved down onto the closure element 22, a lower free end 66 of the sleeve portion 56 will engage the sloping surface of each locking lug 48 on the sloping surface thereof above the adjacent apex 54.

As is shown in FIG. 9, when the retaining sleeve 24 is pushed downwardly to a fully seated position relative to the closure element 22, not only will the apex 52 of each locking lug 48 be forced into the peripheral groove 36 behind the shoulder 38, but also the apex 54 of each of the locking lugs 48 will be received in the locking groove 64. In this manner the closure element 22 is locked to the neck finish 28 in sealing engagement with the end surface 32 of the neck finish and the retaining ring 24 will be locked to the closure element 22.

The retaining sleeve 24 can be removed from the closure element 22 only by forcefully moving the retaining sleeve 24 axially off of the closure element 22. In order to facilitate this, the pull ring 26 is provided. It will be seen that the pull ring 26 is hingedly connected to the retaining sleeve by a hinge 68 so that when the pull ring 26 is moved out of the retaining sleeve 24, it may direct an upward or axial force on the retaining sleeve 24 so as forcefully to disengage the apex 54 of each locking lug 48 from the locking groove 64.

As is best shown in FIG. 1, the pull ring 26, in addition to being connected to the sleeve 24 along the hinge 68, is also connected to the sleeve 24 by way of rupturable straps 70. The straps 70, when broken, give evidence of the container 30 having been previously opened, and thus function as tamper indicating means.

It is to be understood that once the container 30 has been opened by pulling the retaining ring 24 off of the closure element 22 and when pulling the closure element 22 off of the neck finish 28, the product within the container may be readily dispensed. If the entire contents of the container 30 is not dispensed at one time, the container 30 may be reclosed by manually reapplying the closure element 22 and then locking it in place by forcefully telescoping the retaining sleeve 24 thereover.

The closure 20 is particularly intended to be used in conjunction with containers for products such as motor oil and the like where the product is poured into a relatively small opening which may be in a rather inaccessible location. Inasmuch as it is extremely difficult directly to tilt the bottle so that the product contained therein will pour into the required opening, the closure 22 may be beneficially utilized by holding the closure element 22 in its sealed position using one of one's fingers while that finger or another of the fingers passes through the pull ring 26 or the retaining sleeve 24, as shown in FIG. 10. After the bottle has been inverted so that it is in position to pour the contents thereof into the required opening, the finger holding the closure element 22 in place may be removed, thus permitting the closure element 22 to move to an out-of-the-way position and the contents of the container 30 poured without loss. At the same time, since the closure 20 is retained in one's grasp, the closure will not accidentally fall into the opening into which the product is to be poured. When the product is a lubricating oil for an engine, it can be seen that it would be highly undesirable for the closure 20 to drop into the filler tube or opening and into the interior of the engine. Thus not only is the closure 20 particularly adaptable to the pouring of the product without loss or spillage, it is also so constructed that the accidental loss thereof is virtually impossible.

Although only a preferred embodiment of the closure has been specifically illustrated and described herein, it is to be understood that minor variations may be made in the closure and more particularly in the locking means thereof without departing from the spirit and scope of the invention as defined by the appended claims.

What is claimed as new is:

1. A resealable closure for a container having a tubular neck having an external neck finish including a free end and a peripheral groove in an external surface thereof axially spaced from the free end: said closure comprising a closure element including an end panel for sealingly engaging a container, a skirt depending from said end panel, and locking means depending from said skirt, said locking means in an as formed state projecting radially outwardly from and beyond said skirt; a retaining sleeve hingedly connected to said closure element, said retaining sleeve having an internal surface of a size and shape substantially corresponding to the size and shape of the exterior surface of said skirt and forming means for radially inwardly deflecting said locking means into a container peripheral groove for locking said closure element onto a container, said retaining sleeve having formed in said internal surface thereof a locking groove for receiving radially outer portions of said locking means to lock said retaining sleeve on said closure element, and the relationship of said locking means, said locking groove and said retaining sleeve being one wherein said locking sleeve may be removed from the closure element as a unit and replaced.

2. A resealable closure according to claim 1 wherein said locking means has a radially outer and upwardly facing camming surface for engagement by a lower end of said retaining sleeve.

3. A resealable closure according to claim 1 wherein said locking means is of a generally triangular cross section having an upper apex hingedly connected to said skirt and lower radially inwardly and radially outwardly directed apices.

4. A resealable closure according to claim 3 wherein said locking means is in the form of a plurality of separate and peripherally spaced locking elements.

5. A resealable closure according to claim 1 wherein said locking means is of a generally triangular cross section having an upper apex hingedly connected to said skirt and lower radially inwardly and radially outwardly directed apices, said upper apex being connected to a radially outer part of said skirt with said radially inner apex having a minimal projection radially inwardly of said skirt.

6. A resealable closure according to claim 1 wherein said locking means is in the form of a plurality of separate and peripherally spaced locking elements.

7. A resealable closure according to claim 1 together with means for effecting removal of said retaining sleeve as a unit in its entirety.

8. A resealable closure according to claim 1 wherein there is positioned within an upper part of said retaining sleeve and hingedly connected to said retaining sleeve a pull ring for effecting removal of said retaining sleeve as a unit in its entirety.

9. A resealable closure according to claim 8 wherein said pull ring when displaced forms an opening through said retaining sleeve for gripping said retaining sleeve while engaging said closure element.

10. A resealable closure according to claim 1 wherein the hinge connection between said closure element and said retaining sleeve is in the form of a tether strap which extends downwardly from a lower end of said skirt and then upwardly to a lower end of said retaining sleeve.

11. A resealable closure according to claim 1 wherein said closure is applied to a container with said closure element being telescoped over and sealingly engaging the container tubular neck, and said retaining sleeve is telescoped over said closure element with said locking means engaged in said container peripheral groove and said retaining sleeve locking groove.

12. A resealable closure according to claim 11 wherein said container peripheral groove is a square cut groove.

13. A resealable closure according to claim 1 wherein said locking means is of a generally triangular cross section having an upper apex hingedly connected to said skirt and alower radially inwardly and radially outwardly directed apices, said upper apex being connected to a radially outer part of said skirt with said radially inner apex substantially lying within a projection of the internal surface of said skirt.

* * * * *